United States Patent [19]

Harned

[11] 4,164,312

[45] Aug. 14, 1979

[54] DUAL PURPOSE DIVIDER

[75] Inventor: Frederick G. Harned, Martinez, Ga.

[73] Assignee: The Continental Group, Inc., New York, N.Y.

[21] Appl. No.: 910,977

[22] Filed: May 30, 1978

[51] Int. Cl.[2] ..... B65D 5/48

[52] U.S. Cl. ..... 229/15; 229/42; 206/448; 220/22

[58] Field of Search ..... 229/42, 15; 206/456, 206/561, 448

[56] References Cited

U.S. PATENT DOCUMENTS

| | | | |
|---|---|---|---|
| 1,860,567 | 5/1932 | Boeye | 229/42 X |
| 2,800,223 | 7/1957 | Kirk | 220/22 X |
| 3,028,001 | 4/1962 | Gleim | 206/448 |
| 3,384,289 | 5/1968 | Grant | 229/15 |
| 3,727,827 | 4/1973 | Stice | 229/DIG. 3 X |
| 3,921,893 | 11/1975 | Randle, Jr. | 229/15 X |

FOREIGN PATENT DOCUMENTS

| | | | |
|---|---|---|---|
| 1240571 | 8/1960 | France | 229/42 |

*Primary Examiner*—Davis T. Moorhead
*Attorney, Agent, or Firm*—Charles E. Brown

[57] ABSTRACT

A divider for insertion in a box or like container for dividing the container into sections. The divider is formed of a paper product and includes a double thickness primary portion formed of a pair of divider panels joined together along a longitudinal connection with there being an end panel connected to each divider panel at each end thereof and the end panels extending normal to the divider panels. The divider panels in turn have end portions defined by transverse fold lines and the longitudinal connection between the end portions of the divider panels is rupturable, whereby the extent of the divider panels may be reduced and the extent of the end panels may be increased. Thus, a single divider may extend either longitudinally or transversely of a rectangular container.

7 Claims, 5 Drawing Figures

DUAL PURPOSE DIVIDER

This invention relates in general to new and useful improvements in container construction, and more particularly to a divider which may be placed in a container of the box or carton type for dividing the container into separate compartments.

It is well known to provide dividers which include divider panels and end panels with the end panels engaging end walls of a container to position the divider panels within the container and with the divider panels dividing the interior of the container into compartments. However, a different divider is required in each instance.

In accordance with this invention, it is proposed to provide a divider which is so constructed wherein the length of the divider panels and the length of the end panels may be selectively varied so that the effective length of the divider panel may be reduced when so desired.

In accordance with this invention, the divider is formed from a rectangular blank having a longitudinally extending divider line which divides the blank into similar halves and with the divider line in the central portion thereof being in the form of a longitudinal fold line hingedly connecting together a pair of divider panels for folding to face to face relationship. The ends of the divider line are in the form of cuts and set off free end panels which may be folded to positions at right angles to the divider panels. Further, between the end panels and the principal parts of the divider panels the divider line is rupturable and there are additional fold lines in the divider panels which define intermediate panels which may be selectively extensions of the divider panels or extensions of the end panels.

A primary feature of the invention is that a divider may be formed in the normal manner, and merely by providing additional fold lines in the divider panels and by forming the connection between the divider panels at the ends thereof to be rupturable, a divider panel previously usable with only a preselected container may now be usable with two preselected containers or a single container in one position extending longitudinally and in the other position extending transversely.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
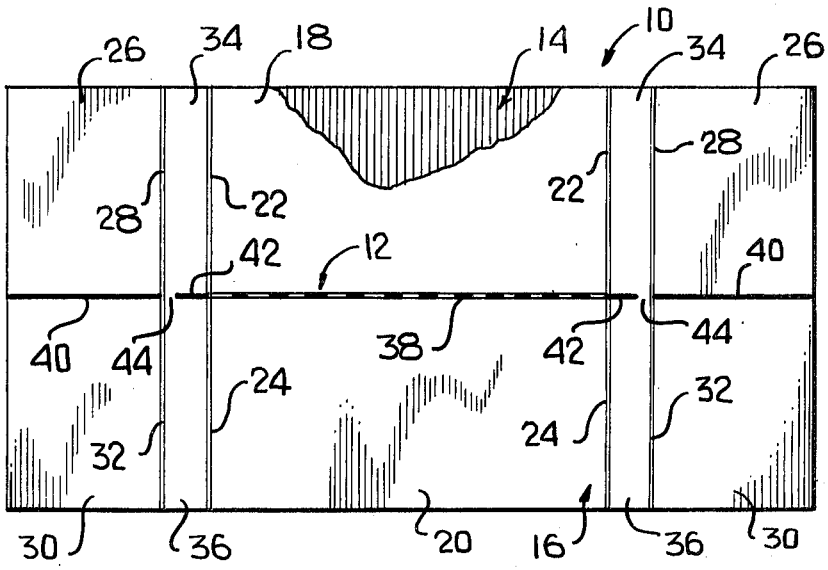
FIG. 1 is a plan view of the blank from which the dual purpose divider is formed.

Referring now to the drawings, reference is first made to FIG. 1 wherein a blank for forming the dual purpose divider is illustrated and is generally identified by the numeral 10. The blank 10 is formed of a suitable paper product such as corrugated board, and is rectangular in outline. The blank 10 is longitudinally divided into two halves by a longitudinally extending divider line, generally identified by the numeral 12. The resultant halves 14 and 16 are normally identical.

Each of the halves 14 and 16 is suitably divided into panels by transverse fold lines. These panels include central panels 18 and 20 defined by transverse fold lines 22 and 24, respectively. These fold lines are in alignment.

The half 14 is further divided into outer panels 26 by outer fold lines 28 while the half 16 is further divided into outer panels 30 by fold lines 32. The fold lines 28 and 32 are transverse fold lines and are in alignment with one another.

Between the fold lines 22, 28 are intermediate panels 34. Like intermediate panels 36 are disposed between the fold lines 24, 32.

The longitudinally extending divider line 12 is divided into several parts and includes a conventional fold line 38 which extends between the fold lines 22,24-22,24. Between the fold lines 28, 32 and the ends of the blank 10 the longitudinally extending divider line 12 is in the form of cuts 40 so that the adjacent panels 26 and 30 are separated from one another.

Between the intermediate panels 34, 36 the longitudinally extending divider line is of a part cut, part rupturable fold line configuration with that portion thereof adjacent the fold line 38 being in the form of a cut 42 and that portion thereof adjacent the cut 40 being in the form of a rupturable fold line 44.

In conventional use, the blank 10 is folded to define a divider generally identified by the numeral 46. The divider 46 has a longer divider panel arrangement and shorter end panels. In this arrangement the intermediate panels 34 and 36 are extensions of the central panels 18 and 20, respectively, thereby providing elongated divider panels 48. The end panels of the divider 46 are formed solely by the end panels 26, 30.

Figure 2:
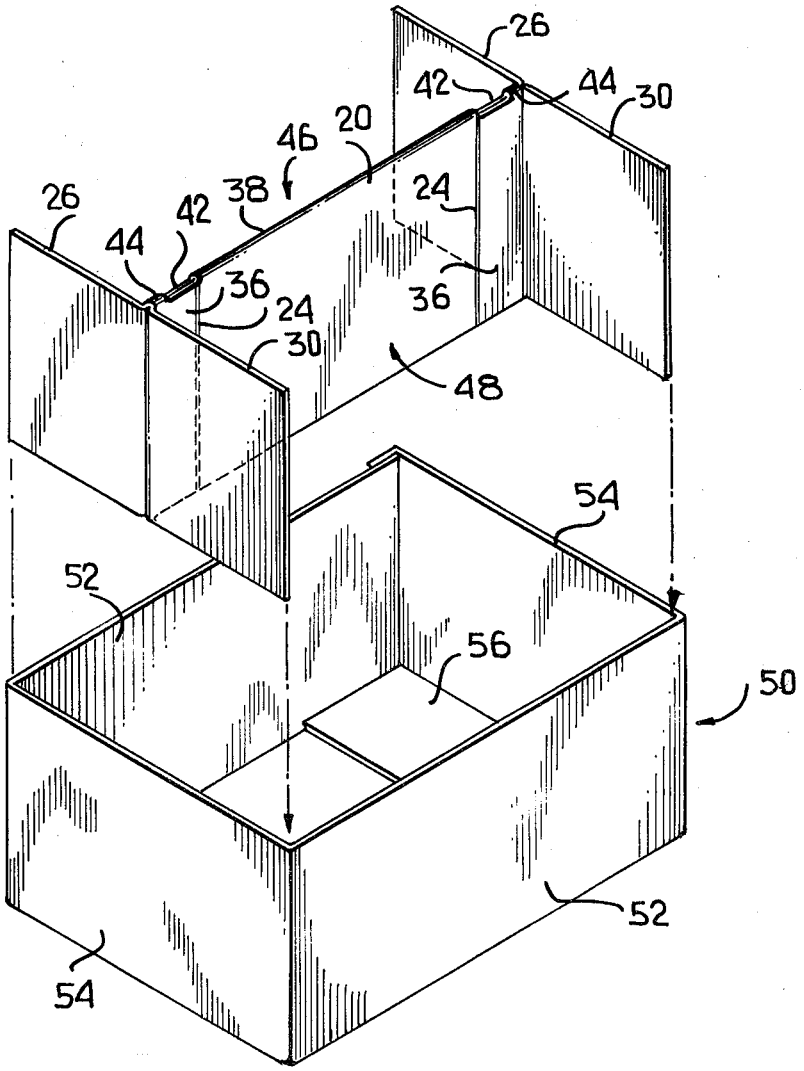
FIG. 2 is an exploded perspective view showing the divider in association with a container for receiving the same.
Figure 3:
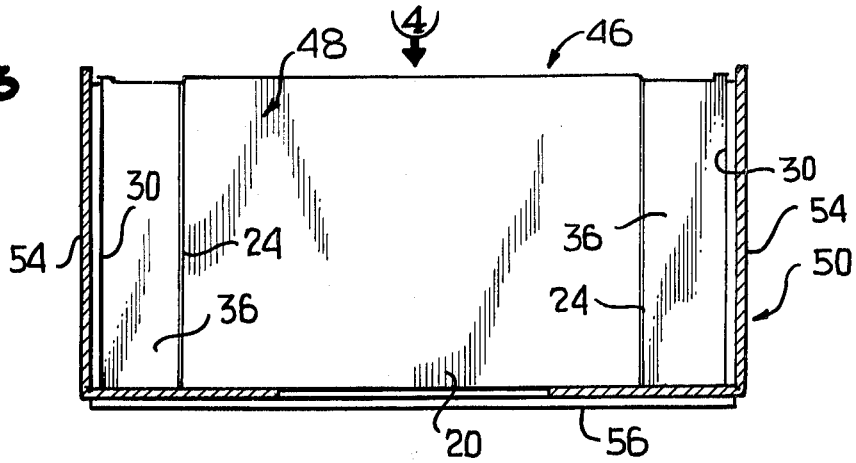
FIG. 3 is a longitudinal sectional view taken through the container of FIG. 2 with the divider in place and the divider being shown in side elevation.
Figure 4:
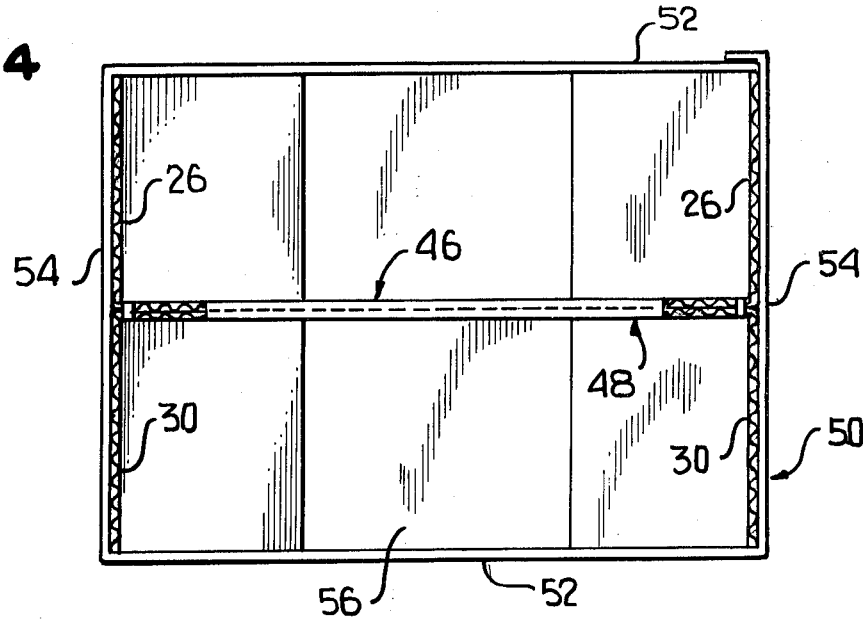
FIG. 4 is a plan view of the container of FIG. 2 with the divider in place.

In FIGS. 2–4, there is also illustrated a conventional container in the form of a carton or box generally identified by the numeral 50. The container 50 has side walls 52 connected together by end walls 54. The container also has a bottom 56.

The divider 46 is so dimensioned that it fits snuggly within the container 50 in a longitudinal position as shown in FIG. 4 with the partition panels 48 extending between the end walls 54 and the end panels 26, 30 being in face to face engagement with the end panels 54 and extending between the side walls 52 longitudinally to position the divider.

Figure 5:
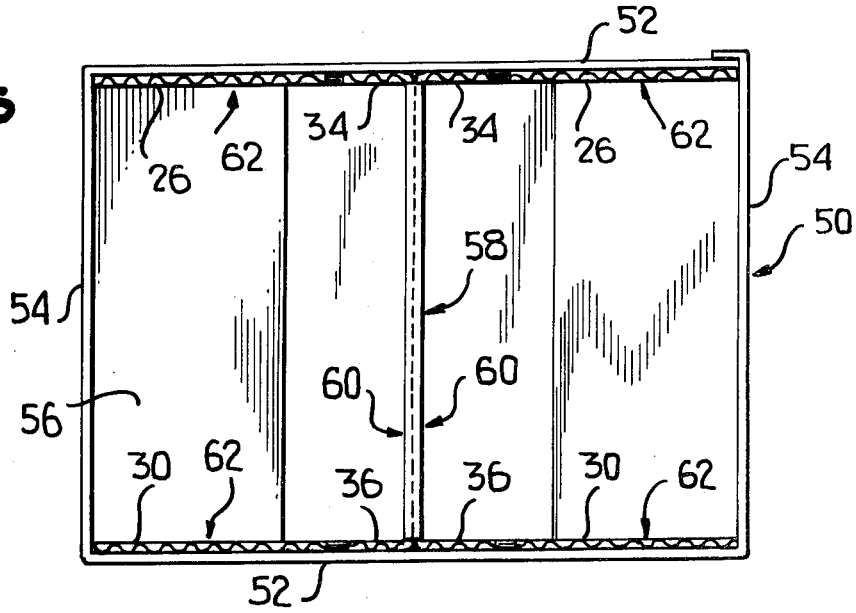
FIG. 5 is a plan view similar to FIG. 4, but with the divider in its modified state and extending transversely of the container.

The foregoing is acknowledged to be a conventional arrangement of a divider and container. However, the same blank 10 or in fact the same divider 46 may be modified so as to have a dual purpose and so as to extend transversely of the container 50, as is shown in FIG. 5.

As set forth above in the description of the blank 10, there are intermediate panels 34 and 36 which are normally extensions of the panels 18 and 20, respectively, and which in the divider arrangement of FIGS. 2–4 form parts of the divider panels 48. However, by rupturing the rupturable fold lines 44, folding may occur along the fold lines 22, 24, thus transferring the intermediate panels 36 from being parts of the divider panels 48 to become parts of the end panels 26, 30. This arrangement is best shown in FIG. 5 with the illustrated divider being identified by the numeral 58. It will be seen that the divider 58 has shorter partition panels 60 and longer end panels 62, each end panel 62 being formed of an outer panel and an intermediate panel.

The divider 58 now extends transversely of the container 50 with the divider panels 60 extending between the side walls 52 and with the end panels 62 extending in face to face engagement with the side walls 52 and between the end walls 54 so as longitudinally to position the divider.

While the dual purpose divider is particularly adapted to be selectively positioned either longitudinally or transversely within a single size rectangular cross section container, it is to be understood that in a like manner the same dual purpose divider may be utilized as a divider with two different containers having respective dimensions matching the two possible dimensions of the divider.

Although only a preferred embodiment of the divider has been specifically illustrated and described herein, it is to be understood that minor variations may be made in the divider without departing from the spirit and scope of the invention as defined by the appended claims.

I claim:

1. A new article of manufacture comprising a blank for a dual purpose divider of the type including a divider wall having at the opposite ends thereof oppositely extending end walls, said divider blank being rectangular in outline, a longitudinally extending divider line dividing said blank into similar halves; each of said halves having central panels defined by inner transverse fold lines, outer panels defined by outer transverse fold lines, and a single intermediate panel between each adjacent pair of said inner and outer fold lines; said longitudinally extending divider line being in the form of a fold line between said outer transverse fold lines and in the form of cuts outwardly of said outer transverse fold lines.

2. The blank of claim 1 wherein between each adjacent ones of said inner and outer fold lines, said longitudinally extending divider line is at least in part a rupturable fold line.

3. The blank of claim 1 wherein between each adjacent ones of said inner and outer fold lines, said longitudinally extending divider line is adjacent a respective one of said outer fold lines a rupturable fold line.

4. The blank of claim 3 wherein said longitudinally extending divider line between each rupturable fold line and the adjacent one of said inner transverse fold lines is a cut.

5. A dual purpose divider comprising a pair of divider panels joined together along a longitudinal connection and arranged in face to face relation, an end panel connected to each divider panel at each end thereof along a transverse fold and extending generally normal to said divider panels, said end panels at each end of said divider panels extending in opposite directions, said divider panels having formed therein adjacent to and spaced from each end thereof transverse fold lines, those portions of said divider panels between adjacent ones of said transverse fold lines and said transverse folds being intermediate panels, and said longitudinal connection including selector means for selectively making said intermediate panels extensions of said divider panels or extensions of said end panels wherein said divider selectively has long divider panels and short end panels or short divider panels and long end panels.

6. The divider of claim 5 wherein said longitudinal connection is in the form of a fold line, and said selector means being rupturable fold line portions at the ends of said fold line.

7. The divider of claim 6 wherein said fold line is interrupted by a cut between each transverse fold line and a respective rupturable fold line portion.

* * * * *